US008712291B2

(12) United States Patent
Suzuki et al.

(10) Patent No.: US 8,712,291 B2
(45) Date of Patent: Apr. 29, 2014

(54) CHARGING MEMBER, ELECTROPHOTOGRAPHIC APPARATUS, AND PROCESS CARTRIDGE

(71) Applicant: Canon Kabushiki Kaisha, Tokyo (JP)

(72) Inventors: Toshiro Suzuki, Gotemba (JP); Yukinori Nagata, Mishima (JP); Masaaki Harada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/929,378

(22) Filed: Jun. 27, 2013

(65) Prior Publication Data

US 2013/0287444 A1 Oct. 31, 2013

Related U.S. Application Data

(63) Continuation of application No. PCT/JP2012/006387, filed on Oct. 4, 2012.

(30) Foreign Application Priority Data

Feb. 24, 2012 (JP) ..... 2012-038973

(51) Int. Cl.
*G03G 15/02* (2006.01)

(52) U.S. Cl.
USPC ..... 399/176

(58) Field of Classification Search
USPC ..... 399/176
See application file for complete search history.

(56) References Cited

U.S. PATENT DOCUMENTS

2012/0045250 A1 2/2012 Harada et al.

FOREIGN PATENT DOCUMENTS

| | | | |
|---|---|---|---|
| JP | 9-179380 | A | 7/1997 |
| JP | 2004-361843 | A | 12/2004 |
| JP | 2006-119451 | A | 5/2006 |
| JP | 2006-258932 | A | 9/2006 |
| JP | 2007-52070 | A | 3/2007 |
| JP | 2009-80369 | A | 4/2009 |
| JP | 2011-154192 | A | 8/2011 |
| JP | 2012-37875 | A | 2/2012 |

OTHER PUBLICATIONS

PCT International Search Report and Written Opinion of the International Searching Authority, International Application No. JP2012/006387, Mailing Date Nov. 6, 2012.

*Primary Examiner* — Walter L Lindsay, Jr.
*Assistant Examiner* — Frederick Wenderoth
(74) *Attorney, Agent, or Firm* — Fitzpatrick, Cella, Harper and Scinto

(57) ABSTRACT

Provided is a charging member capable of stably charging an object to be charged while suppressing adhesion of toner or an external additive onto a surface of an elastic layer and compression set of an abutting portion of the elastic layer. The charging member is a charging member, comprising a mandrel; and an electro-conductive elastic layer, wherein: the elastic layer has a universal hardness decreasing from a surface toward a depth direction thereof; and the hardnesses at a central portion and both end portions in a longitudinal direction of the charging member satisfy the relationships: in the surface of the elastic layer, the hardnesses at the both end portions are higher than that at the central portion; and at a position having a depth of t (μm) from the surface of the elastic layer, the hardness at the central portion is higher than those at the both end portions.

10 Claims, 4 Drawing Sheets

CHARGING MEMBER, ELECTROPHOTOGRAPHIC APPARATUS, AND PROCESS CARTRIDGE

CROSS-REFERENCE TO RELATED APPLICATIONS

This application is a continuation of International Application No. PCT/JP2012/006387, filed Oct. 4, 2012, which claims the benefit of Japanese Patent Application No. 2012-038973, filed Feb. 24, 2012.

BACKGROUND OF THE INVENTION

1. Field of the Invention

The present invention relates to a charging member to be used in an electrophotographic apparatus, an electrophotographic apparatus, and a process cartridge.

2. Description of the Related Art

In an electrophotographic apparatus, a contact charging mode has been adopted as a process for subjecting a surface of an image bearing member such as a photosensitive member or a dielectric member to a charging treatment. As a charging member to be used in the contact charging mode, there has been used an elastic roller having an elastic layer containing a rubber or a thermoplastic elastomer in order to ensure a uniform nip width (close contact width) with an object to be charged and to prevent the object to be charged from being damaged. Such elastic roller is generally brought into pressure contact with an image bearing member by applying a predetermined force to an axis at both end portions of the elastic roller. Hence, there is a tendency that nip pressures at end portions are high as compared to a nip pressure at a central portion in a longitudinal direction of the elastic roller. Therefore, in the case where such elastic roller is applied as the charging member to the electrophotographic apparatus, dirt is liable to be accumulated at the central portion in the longitudinal direction of the elastic roller through formation of electrophotographic images over a long period of time. In addition, the dirt causes streak-like unevenness on the electrophotographic images in some cases.

Meanwhile, Japanese Patent Application Laid-Open No. 2006-119451 mentions the following problem. That is, when an elastic roller is abutted on an image bearing member, a nip width does not become uniform in a longitudinal direction of the elastic roller, and hence a distribution occurs in nip pressure, resulting in toner dirt and image unevenness. In addition, Japanese Patent Application Laid-Open No. 2006-119451 describes that such problem can be solved by modifying an outer peripheral surface of the elastic roller, that is, a surface of an elastic layer at different treatment levels in a thrust direction of the elastic roller. Japanese Patent Application Laid-Open No. 2006-119451 mentions ultraviolet irradiation and electron beam irradiation as specific examples of a method for the modification of the surface of the elastic layer.

SUMMARY OF THE INVENTION

According to studies made by the inventors of the present invention, the method as described in Japanese Patent Application Laid-Open No. 2006-119451 cannot sufficiently improve nip pressure unevenness in the thrust direction of the elastic roller abutting on an object to be charged.

In view of the foregoing, the present invention is directed to providing a charging member which hardly causes nip pressure unevenness in the longitudinal direction even when brought into pressure contact with an object to be charged by applying a load to both ends of a mandrel, and whose surface hardly undergoes accumulation of dirt due to nip pressure unevenness in the longitudinal direction even when used for a long period of time.

Further, the present invention is directed to providing an electrophotographic apparatus and a process cartridge capable of stably providing a high-quality electrophotographic image.

According to one aspect of the present invention, there is provided a charging member, comprising: a mandrel; and an electro-conductive elastic layer, wherein: the elastic layer has a universal hardness decreasing from a surface toward a depth direction thereof; and the universal hardnesses of the elastic layer at a central portion and both end portions in a longitudinal direction of the charging member satisfy the following relationships: with respect to the surface of the elastic layer, the universal hardnesses at the both end portions are higher than that at the central portion; and with respect to a position having a depth of t μm from the surface of the elastic layer, the universal hardness at the central portion is higher than those at the both end portions.

According to another aspect of the present invention, there is provided an electrophotographic apparatus, comprising: the above-described charging member; and an electrophotographic photosensitive member disposed in contact with the charging member.

According to further aspect of the present invention, there is provided a process cartridge, comprising: the above-described charging member; and an electrophotographic photosensitive member, wherein the process cartridge is detachably mountable to a main body of an electrophotographic apparatus.

According to the present invention, there is provided the charging member which hardly causes nip pressure unevenness in the longitudinal direction even when brought into pressure contact with an object to be charged by applying a load to both ends of a mandrel, and which hardly undergoes accumulation of dirt at the central portion of an elastic layer in the longitudinal direction even when used for a long period of time.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The inventors of the present invention have made extensive studies in view of the above-mentioned objects. As a result, the inventors have found that the objects can be satisfactorily achieved by a charging member, including a mandrel and an electro-conductive elastic layer, in which the elastic layer has a universal hardness decreasing from a surface toward a depth direction thereof, and the universal hardnesses of the elastic layer at a central portion and both end portions in a longitudinal direction of the charging member satisfy the following relationships: in the surface of the elastic layer, the universal hardnesses at the both end portions are higher than that at the central portion; and at a position having a depth of t (μm) from the surface of the elastic layer, the universal hardness at the central portion is higher than those at the both end portions.

<Charging Member>

Figure 1:
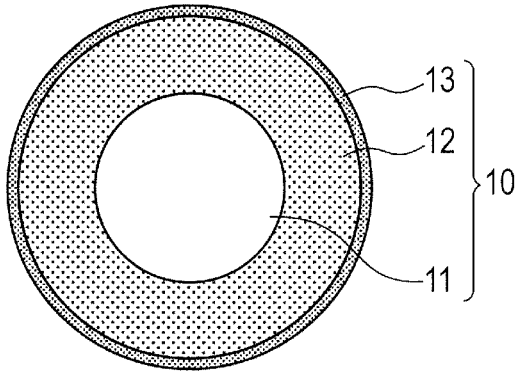
FIG. 1 is a cross-sectional diagram of a charging roller according to the present invention.

Hereinafter, a charging member having a roller shape (hereinafter, referred to as "charging roller") according to the present invention is described with reference to FIG. 1. A charging roller 10 according to the present invention includes a mandrel 11 and an electro-conductive elastic layer 12 on the mandrel 11.

<Mandrel>

As the mandrel 11, there may be used a stainless-steel bar containing a steel material such as an SUM material plated with nickel or chromium, a phosphor bronze bar, an aluminum bar, a heat-resistant resin bar, and the like.

<Elastic Layer>

A material which forms the electro-conductive elastic layer is a mixture of a polymer and an additive. The polymer is not particularly limited as long as it is a material exhibiting rubber elasticity. Specific examples of the rubber material include: thermosetting rubber materials obtained by compounding a cross-linking agent into raw material rubbers such as a natural rubber (NR), an isoprene rubber (IR), a butadiene rubber (BR), a styrene-butadiene rubber (SBR), an isobutylene-isoprene rubber (IIR), an ethylene-propylene-diene terpolymer rubber (EPDM), an epichlorohydrin homopolymer (CHC), an epichlorohydrin-ethylene oxide copolymer (CHR), an epichlorohydrin-ethylene oxide-allyl glycidyl ether terpolymer (CHR-AGE), an acrylonitrile-butadiene rubber (NBR), a hydrogenated NBR (H-NBR), a chloroprene rubber (CR), and an acrylic rubber (ACM, ANM); and thermoplastic elastomers such as a polyolefin-based thermoplastic elastomer, a polystyrene-based thermoplastic elastomer, a polyester-based thermoplastic elastomer, a polyurethane-based thermoplastic elastomer, a polyamide-based thermoplastic elastomer, and a polyvinyl chloride-based thermoplastic elastomer. Further, a blended mixture of those polymers may be used.

Further, an agent is added to the polymer for the purpose of adjusting the electric resistance value of the elastic layer. Examples of the agent include: carbon materials such as carbon black and graphite; oxides such as titanium oxide and tin oxide; metals such as Cu and Ag; electron conductive agents such as electro-conductive particles rendered electro-conductive by coating particle surfaces with an oxide or a metal; inorganic ionic substances such as lithium perchlorate, sodium perchlorate, and calcium perchlorate; cationic surfactants such as lauryltrimethylammonium chloride, stearyltrimethylammonium chloride, octadecyltrimethylammonium chloride, dodecyltrimethylammonium chloride, hexadecyltrimethylammonium chloride, trioctylpropylammonium bromide, and a modified aliphatic dimethylethylammonium ethosulfate; zwitterionic surfactants such as lauryl betaine, stearyl betaine, and dimethylalkyllauryl betaine; quaternary ammonium salts such as tetraethylammonium perchlorate, tetrabutylammonium perchlorate, and trimethyloctadecylammonium perchlorate; and ion conductive agents such as organic acid lithium salts including lithium trifluoromethanesulfonate. In addition, spherical particles may be added to the polymer for the purpose of adjusting the surface roughness of the elastic layer. The spherical particles may be any of organic particles and inorganic particles.

A filler, a processing aid, an antioxidant, a cross-linking aid, a cross-linking accelerator, a cross-linking supplement accelerator, a cross-linking retarder, a dispersant, and the like, which are generally used as compounding agents for a rubber, may be added to the polymer as required. A mixing method for those materials may be exemplified by a mixing method using a closed mixer such as a Banbury mixer or a pressure kneader and a mixing method using an open mixer such as an open roll.

A molding method for a rubber roller having a rubber layer to serve as an elastic layer provided on a mandrel may be exemplified by, but not particularly limited to, an injection molding method, an extrusion molding method, a transfer molding method, and a press molding method. For example, the injection molding method involves assembling two cylindrical dies, and injecting a rubber material in a state in which a shaft-shaped mandrel is held concentrically in a cylindrical mold, followed by heating, thereby curing the rubber material to be molded into a rubber roller. Further, the extrusion molding method involves extruding a rubber material into a tube shape and covering a mandrel with the tube-shaped rubber material to be molded into a rubber roller, or integrally extruding a mandrel and a rubber material to be molded into a rubber roller having a cylindrical shape. Of those molding methods, a crosshead extrusion molding method involving integrally extruding a mandrel and a rubber material to be molded into a rubber roller is most preferred because continuous production is easy, the number of steps is small, and thus the method is suitable for manufacture at low cost.

Any of methods such as a hot-air oven, a vulcanizer, a heating platen, far- and near-infrared radiation, and induction heating may be employed as a method of vulcanizing a rubber roller by heating. In addition, a method involving pressing a rubber roller against a cylindrical or planar member in a heated state while allowing the rubber roller to rotate may be employed in combination with any of the above-mentioned methods. The rubber roller is preferably heated at a temperature within a range of 140° C. or more and 220° C. or less for a time of 10 minutes or more and 120 minutes or less to vulcanize the rubber roller.

It should be noted that grinding process for grinding the surface of the rubber roller is exemplified by, but not particularly limited to, a so-called traverse mode involving performing grinding by movement of grindstone, and a plunge mode involving performing grinding at a time through use of grindstone having a larger width without any movement of the grindstone. The plunge mode is more preferred because of having an advantage in that the full width of the rubber roller can be ground at a time, thereby enabling a processing time to be shortened as compared to the traverse mode.

In this case, the charging roller performs a charging treatment in the following manner in many cases. That is, the charging roller is brought into contact with an object to be charged by applying several hundreds of grams of a load to each of both ends of a mandrel, and while allowing the object to be charged to rotate, the charging roller is allowed to rotate according to the rotation. When the charging roller is brought into contact with the object to be charged as described above, the thickness of the rubber layer to serve as the elastic layer of the charging roller is preferably 0.5 mm or more and 3.5 mm or less. The control of the thickness of the rubber layer to 0.5 mm or more leads to an increase in effect as an elastic member, thereby enabling a uniform nip width to be ensured. Further, leakage discharge due to close contact of a mandrel with an object to be charged can also be suppressed. The control of the thickness of the rubber layer to 3.5 mm or less can suppress an increase in size of an electrophotographic apparatus and an increase in torque for allowing an object to be charged to rotate. In addition, the control of the thickness of the rubber layer to 1.0 mm or more and 3.0 mm or less can suppress compression set of the abutting portion of the rubber layer due to an increase in nip width and an increase in pressure distribution in a nip width.

In addition, when the charging roller is brought into contact with the object to be charged, the charging roller preferably has such a crown shape that the outer diameters at both end portions are smaller than the outer diameter at a central portion in the longitudinal direction. The crown amount is preferably 60 μm or more and 220 μm or less. The control of the crown amount to 60 μm or more and 220 μm or less enables a uniform nip width to be ensured and can suppress the compression set of the abutting portion of the rubber layer. In this regard, the crown amount is a difference between an outer diameter D2 at the central portion of the charging member and outer diameters D1 and D3 at positions 90 mm away from the central portion toward both end directions, respectively, and is a value calculated from the following equation (1).

$$\text{Crown amount } C = D2 - (D1 + D3)/2 \quad (1)$$

The thickness and crown amount of the rubber layer of the charging roller may be adjusted by grinding involving grinding the surface of the rubber roller.

In addition, the elastic layer according to the present invention has a universal hardness value decreasing from the surface toward the depth direction thereof by virtue of a cured region 13 present on a side of a surface on an opposite side to a side of the elastic layer facing the mandrel (hereinafter, referred to as "surface"). Further, with regard to universal hardness values at the central portion and both end portions (e.g., positions 90 mm away from the central portion toward both end directions, respectively) in the longitudinal direction of the elastic layer: in the surface of the elastic layer, the values at the both end portions are higher than the value at the central portion; whereas at a position having a depth of t μm from the surface of the elastic layer, the value at the central portion is higher than the values at the both end portions.

In the case of bringing the charging member, in which the relationship between universal hardnesses at the central portion and both end portions in the longitudinal direction of the elastic layer in the surface of the elastic layer is opposite to that at the position having a depth of t μm from the surface of the elastic layer as described above, into pressure contact with an object to be charged by applying a load to both ends of a mandrel, nip pressure unevenness in the longitudinal direction of the charging member can be suppressed to a small value.

As a result, the charging member according to the present invention hardly causes local accumulation of dirt such as toner on the surface of the charging member due to nip pressure unevenness even when used over a long period of time, which contributes to the stable formation of a high-quality electrophotographic image.

Meanwhile, a value for a depth of t μm corresponding to a position at which the relationship between universal hardnesses at the central portion and both end portions in the longitudinal direction of the elastic layer becomes opposite to that in the surface of the elastic layer is preferably 5 μm or more and 50 μm or less as a measure thereof. The control of the value for the depth t to 5 μm or more and 50 μm or less can more certainly make uniform the distribution of nip pressure with the object to be charged in the longitudinal direction of the charging member.

The elastic layer according to the present invention cannot be produced by simply irradiating a layer of a rubber mixture with electron beams at a higher dose at the both end portions than at the central portion in the longitudinal direction of the elastic layer as described in Examples of Japanese Patent Application Laid-Open No. 2006-119451. That is, electron beams are required to penetrate a portion having a larger depth at the central portion than at the both end portions in the longitudinal direction of the elastic layer, which is the layer of a rubber mixture, in order to obtain the elastic layer according to the present invention.

Specifically, the elastic layer according to the present invention may be formed by subjecting a rubber layer to a surface treatment according to a method as mentioned in the following item (1), (2), or (3):

(1) a method involving performing scanning and irradiation with electron beams in a fan-shaped fashion from a central portion as a center toward both end portions in the longitudinal direction of a charging member through use of a curing treatment of a surface of a rubber layer by electron beam irradiation;

(2) a method involving performing irradiation with electron beams while changing accelerating voltages at a central portion and both end portions in the longitudinal direction of a charging member so as to be increased and decreased, respectively; or (3) a method involving performing irradiation with electron beams having different accelerating voltages while partially masking the longitudinal direction of a charging member.

A curing treatment method for the surface of the elastic layer using electron beam irradiation can be completed in only three steps, i.e., a charging member molding step, a grinding step, and an electron beam irradiation step and does not require surface layer coating and curing steps, which enables the manufacture in a small number of steps.

(Electron Beam Irradiation Apparatus)

Figure 2:
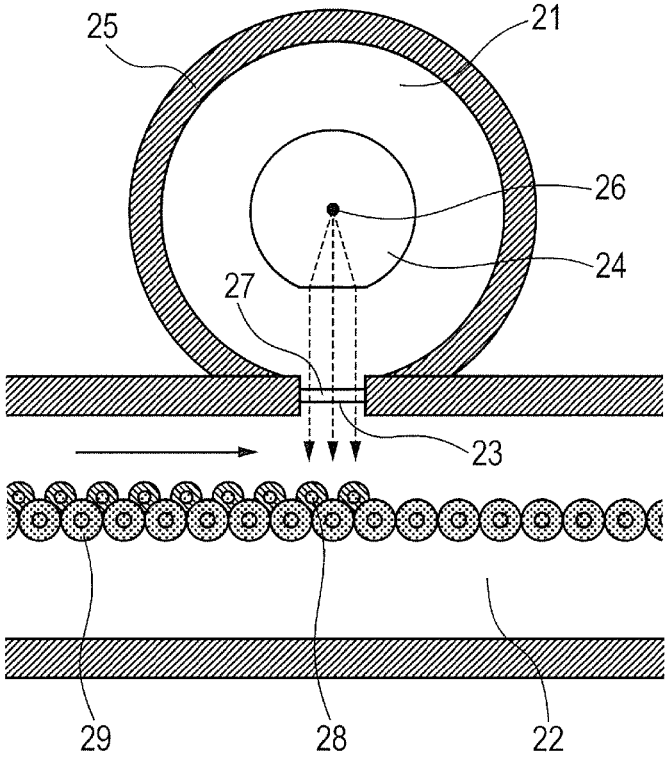
FIG. 2 is an explanatory diagram of an electron beam irradiation apparatus to be used in the manufacture of a charging roller according to the present invention.

Here, FIG. 2 illustrates a schematic diagram of a general electron beam irradiation apparatus. The electron beam irradiation apparatus to be used in the present invention is an apparatus capable of irradiating the surface of the rubber roller with an electron beam while allowing the rubber roller to rotate. As illustrated in FIG. 2, the apparatus includes an electron beam generating portion 21, an irradiation chamber 22, and an irradiation hole 23.

The electron beam generating portion 21 has an accelerating tube 25 for accelerating an electron beam generated from an electron source (electron gun) 24 in a vacuum space (accelerating space). Further, the inside of the electron beam generating portion is kept at a vacuum of $10^{-3}$ to $10^{-6}$ Pa with a vacuum pump (not shown) or the like in order to prevent an electron from colliding with a gas molecule to lose energy.

When a filament 26 is heated by being applied with a current by a power source (not shown), the filament 26 releases thermoelectrons, and the thermoelectrons are extracted effectively as an electron beam. Then, the electron beam is accelerated in the accelerating space in the accelerating tube 25 with an accelerating voltage. After that, the electron beam passes through an irradiation hole foil 27 to irradiate a rubber roller 28 conveyed in the irradiation chamber 22 on the lower side of the irradiation hole 23.

As described in this embodiment, when the rubber roller 28 is irradiated with the electron beam, the inside of the irradiation chamber 22 is set to a nitrogen atmosphere. Further, the rubber roller 28 is allowed to rotate with a member for roller rotation 29 and moves from the left side to the right side in FIG. 2 by conveying unit in the irradiation chamber. It should be noted that the electron beam generating portion 21 and the irradiation chamber 22 are surrounded by lead shielding or stainless-steel shielding (not shown) in order to prevent an X-ray to be generated secondarily upon irradiation with an electron beam from leaking to the outside.

The irradiation hole foil 27 is formed of a metal foil and separates a vacuum atmosphere in the electron beam generating portion from a nitrogen atmosphere in the irradiation chamber. Further, an electron beam is extracted into the irradiation chamber via the irradiation hole foil 27. Accordingly, the irradiation hole foil 27 to be provided at the boundary between the electron beam generating portion 21 and the irradiation chamber 22 desirably has no pinhole, has a mechanical strength enough to maintain a vacuum atmosphere in the electron beam generating portion, and allows an electron beam to pass therethrough easily. Therefore, the irradiation hole foil 27 is desirably a metal foil having a small specific gravity and a small thickness, and an aluminum foil, a titanium foil, a beryllium foil, a carbon film, or the like is generally used. For example, there is used a foil of a thin film having a thickness of about 5 μm or more and about 30 μm or less. Conditions for a curing treatment with an electron beam depend on the accelerating voltage and dose of the electron beam. The accelerating voltage affects a curing treatment depth. A condition for the accelerating voltage in the present invention is preferably a range of 40 to 300 kV as a low energy region. At 40 kV or more, a cured region having a sufficient thickness for obtaining the effects of the present invention can be obtained. Further, the control of the accelerating voltage to 300 kV or less can suppress an increase in size of an electron beam irradiation apparatus and an increase in apparatus cost. The accelerating voltage is more preferably a range of 70 to 150 kV.

The dose of the electron beam in the electron beam irradiation is defined by the following equation (2).

$$D=(K\cdot I)/V \quad (2)$$

In the equation, D represents a dose (kGy), K represents an apparatus constant, I represents an electron current (mA), and V represents a treatment speed (m/min). The apparatus constant K is a constant representing the efficiency of an individual apparatus, and is an indicator of the performance of the apparatus. The apparatus constant K may be determined by measuring the dose while changing the electron current and the treatment speed under a constant-accelerating voltage condition. The dose of the electron beam is measured as described below. A film for dosimetry is attached to the surface of the roller, the surface of the roller is actually irradiated with the electron beam, and the film for dosimetry is subjected to measurement of the dose with a film dosimeter. The film for dosimetry and the film dosimeter to be used may be an FWT-60 and FWT-92D (each of which is manufactured by Far West Technology, Inc.), respectively.

The dose of the electron beam in the present invention preferably falls within a range of 30 to 3,000 kGy. The control of the dose to 30 kGy or more can easily provide a surface hardness enough to provide the effect of the present invention. Further, the control of the dose to 3,000 kGy or less can suppress an increase in manufacturing cost due to upsizing of an electron beam irradiation apparatus or an increase in treatment time. The dose of the electron beam more preferably falls within a range of 200 to 2,000 kGy.

(Scanning Type Electron Beam Irradiation Source)

Figure 3:
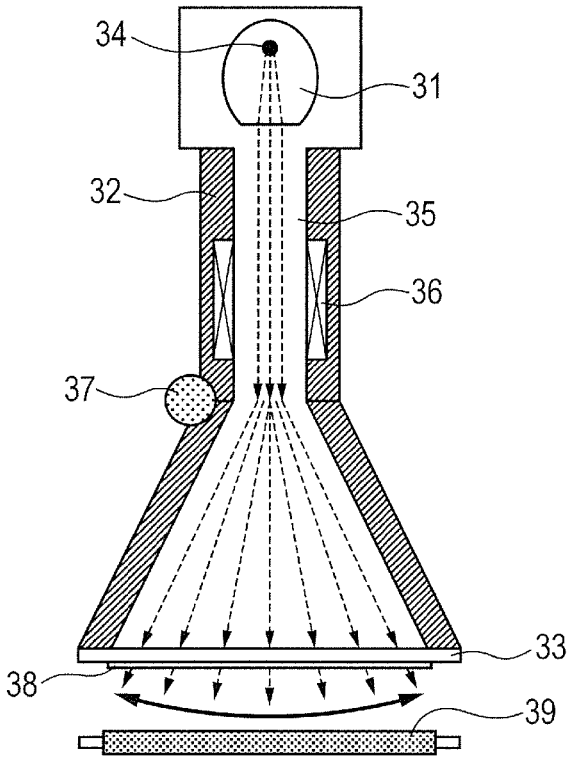
FIG. 3 is an explanatory diagram of a scanning type electron beam irradiation source to be used in the manufacture of a charging roller according to the present invention.

Next, a scanning type electron beam irradiation source which may be used in the present invention is described in detail. As illustrated in FIG. 3, the scanning type electron beam irradiation source includes an electron gun 31, a container for an electron beam generating portion 32, and an irradiation hole 33. The scanning type electron beam irradiation source is an apparatus which deflects electron beams emitted from the electron gun 31 at high speed in a predetermined direction, thereby performing electron beam scanning and irradiation in a fan-shaped fashion from the irradiation hole 33.

The electron gun 31 has filaments 34 for emitting electron beams. An electron beam passing hole 35 is surrounded by electromagnetic coils 36 disposed along the exit axis of electron beams emitted from the filaments 34. The center of the electromagnetic coils 36 is coincident with the central axis of the electron beam passing hole 35. By virtue of the electromagnetic coils 36, electron beams, which pass through the electron beam passing hole 35, are focused toward the irradiation hole 33. Further, a vacuum pump (not shown) is connected to the side portion of the container for an electron beam generating portion 32, and the inside of the electron beam generating portion is kept at a vacuum of $10^{-3}$ to $10^{-6}$ Pa in order to prevent electrons from losing energy by collision with gas molecules.

Further, the container for an electron beam generating portion 32 is provided with a deflecting coil 37. The electron beams, which have passed through the electron beam passing hole 35, are deflected in a fan-shaped fashion by the deflecting coil 37. The deflecting coil 37 deflects the electron beams from side to side at high speed as illustrated in FIG. 3, based on a value for a frequency and a current to be supplied from an AC power source (not shown). The frequency of the electron beams to be deflected is preferably set to 100 Hz or more so as not to cause electron beam irradiation unevenness.

The electron beams deflected in a fan-shaped fashion by the deflecting coil 37 pass through an irradiation window 38 provided on the irradiation hole 33 so as to irradiate a surface of a rubber roller 39 outside the scanning type electron beam irradiation source. Further, the irradiation window 38 for the electron beams is formed of, for example, a titanium foil or a beryllium foil having a thickness of about several μm to 10 μm.

The elastic layer according to the present invention, in which the relationships between universal hardnesses at the central portion and both end portions in the longitudinal direction in a surface and at a position having a depth of t μm from the surface are opposite to each other, can be obtained by performing the surface treatment of the rubber layer through use of the scanning type electron beam irradiation source.

Specifically, as illustrated in FIG. 3, the electron beam irradiation is performed in a fan-shaped fashion symmetrically from the central portion in the longitudinal direction of the rubber roller as a center toward the both end portions of the rubber layer of the rubber roller. With this, the electron beams with which the central portion and both end portions in the longitudinal direction of the rubber layer are irradiated have different incident angles upon the rubber layer even at the same accelerating voltage. Hence, the electron beams have different penetration degrees in the depth direction of the rubber layer. As a result, the electron beams penetrate a portion having a larger depth at the central portion than at the both end portions in the longitudinal direction of the rubber layer.

With this, it is possible to provide the charging member according to the present invention, in which the elastic layer has a universal hardness value decreasing from the surface toward the depth direction thereof, and with regard to universal hardness values at the central portion and both end portions in the longitudinal direction of the elastic layer: in the surface of the elastic layer, the values at the both end portions are higher than the value at the central portion; and at a position having a depth of t μm from the surface of the elastic layer, the value at the central portion is higher than the values at the both end portions. It is also possible to provide the charging member according to the present invention by performing electron beam irradiation in a fan-shaped fashion while controlling the accelerating voltages at the central portion and both end portions in the longitudinal direction of the rubber roller so as to be increased and decreased through use of the scanning type electron beam irradiation source.

(Area Type Electron Beam Irradiation Source)

Figure 4:
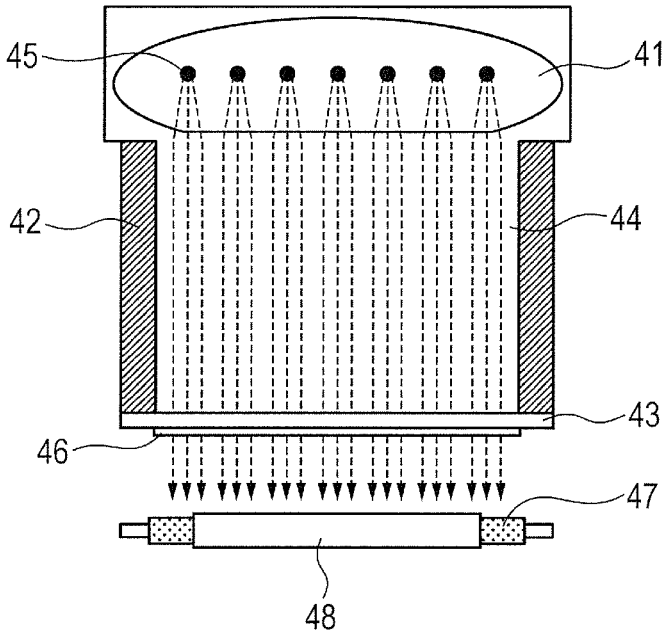
FIG. 4 is an explanatory diagram of an area type electron beam irradiation source to be used in the manufacture of a charging roller according to the present invention.

Next, an area type electron beam irradiation source which may be used in the present invention is described in detail. As illustrated in FIG. 4, the area type electron beam irradiation source includes an electron gun 41, a container for an electron beam generating portion 42, and an irradiation hole 43. The area type electron beam irradiation source is an apparatus which accelerates electron beams emitted from the electron gun 41 by an accelerating tube 44 in a vacuum space (accelerating space) and irradiates a predetermined area with the electron beams in a linear fashion from the irradiation hole 43.

The electron gun 41 has multiple filaments 45 for releasing electron beams. Electron beams emitted from the multiple filaments 45 are accelerated by the accelerating tube 44 in a vacuum space (accelerating space) so as to be output to the irradiation hole 43. Further, a vacuum pump (not shown) is connected to the side portion of the container for the electron beam generating portion 42, and the inside of the electron beam generating portion and the accelerating tube 44 are kept at a vacuum of $10^{-3}$ to $10^{-6}$ Pa in order to prevent electrons from losing energy by collision with gas molecules.

The electron beams emitted in a linear fashion from the multiple filaments 45 pass through an irradiation window 46 provided on the irradiation hole 43 so as to irradiate a surface of a rubber roller 47 outside the area type electron beam irradiation source. Further, the irradiation window 46 for the electron beams is formed of, for example, a titanium foil or a beryllium foil having a thickness of about several μm to 10 μm.

The use of the area type electron beam irradiation source enables the universal hardness in the depth direction of the rubber layer to be controlled. Specifically, the control can be achieved as described below. As illustrated in FIG. 4, a masking 48 is provided on the surface of the rubber roller except only both end portions each having a predetermined width (e.g., each having a width of 10 mm) in the longitudinal direction of the rubber roller, and in this state, electron beam irradiation is performed at a low accelerating voltage. After that, a non-masking portion is shifted sequentially by a predetermined width toward the direction of the central portion to provide the masking 48 on the surface of the rubber roller. Every time the non-masking portion is shifted, an accelerating voltage is gradually increased, and irradiation is repeatedly performed at such accelerating voltage. Through such masking operation, the both end portions of the rubber roller can be irradiated with electron beams at a low accelerating voltage, and the central portion of the rubber roller can be irradiated with electron beams at a high accelerating voltage. Hence, the penetration distance of electron beams from the surface toward the depth direction of the rubber layer at the central portion and both end portions can be changed. Further, the masking 48 on the surface of the rubber roller also prevents electron beams from passing therethrough, and for example, a sheet made of stainless steel and having a thickness of about 50 μm or more is used for the masking.

Thus, it is possible to provide the charging member according to the present invention, characterized in that the elastic layer has a universal hardness value decreasing from the surface toward the depth direction thereof, and with regard to universal hardness values at the central portion and both end portions in the longitudinal direction of the elastic layer: in the surface of the elastic layer, the values at the both end portions are higher than the value at the central portion; and at a position having a predetermined depth or more from the surface of the elastic layer, the value at the central portion is higher than the values at the both end portions.

In this case, a level of a curing treatment with electron beams and a curing treatment depth vary depending on the dose and accelerating voltage of the electron beams. Further, it is generally known that the penetration depth of the electron beams varies depending on the density of a substance to be irradiated as well. A method of confirming the actual hardness distribution and curing treatment depth of the elastic layer is exemplified by a measurement method for a surface hardness using a universal hardness meter.

A universal hardness is a physical property value determined by pressing an indenter into an object of measurement while applying a load, and is determined by (Test load)/(Surface area of indenter under test load) ($N/mm^2$). The universal hardness may be measured with, for example, a hardness measurement apparatus such as an ultra-micro hardness meter (trade name: H-100V, manufactured by Fischer).

In the measuring apparatus, the indenter such as a quadrangular pyramid is pressed into the object of measurement while a predetermined, relatively small test load is applied. At the point in time when a predetermined pressing depth is achieved, the surface area of the indenter in contact with the object is determined from the pressing depth, and the universal hardness is determined from the above-mentioned expression. In other words, when the indenter is pressed into the object of measurement under a constant-load measurement condition, a ratio of a stress at the time to the depth to which the indenter is pressed is defined as the universal hardness.

Figure 5:
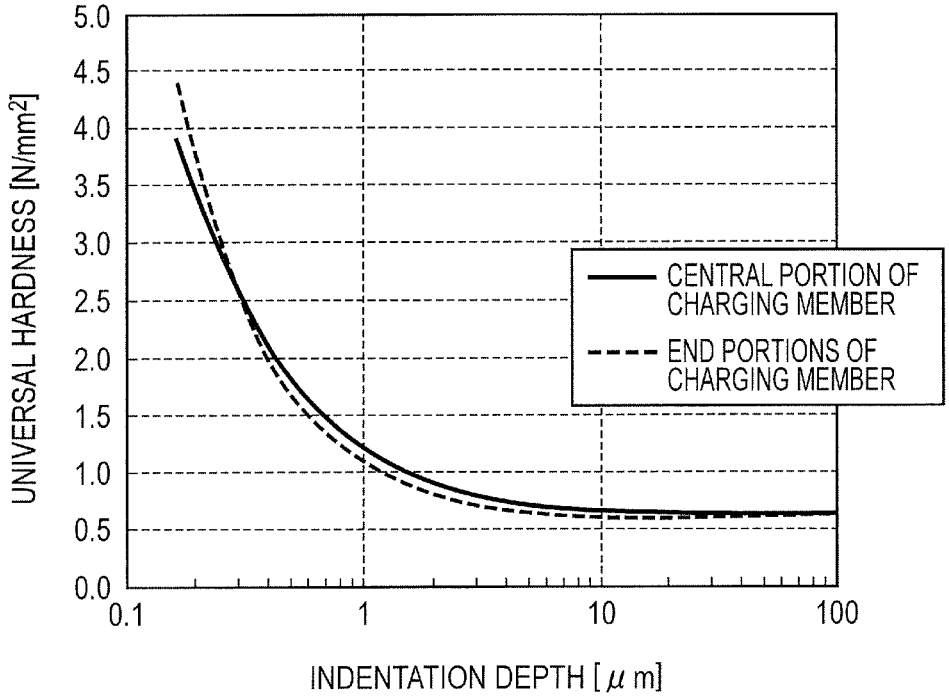
FIG. 5 is a graph showing universal hardness distributions of a charging member according to Example 1.
Figure 6:
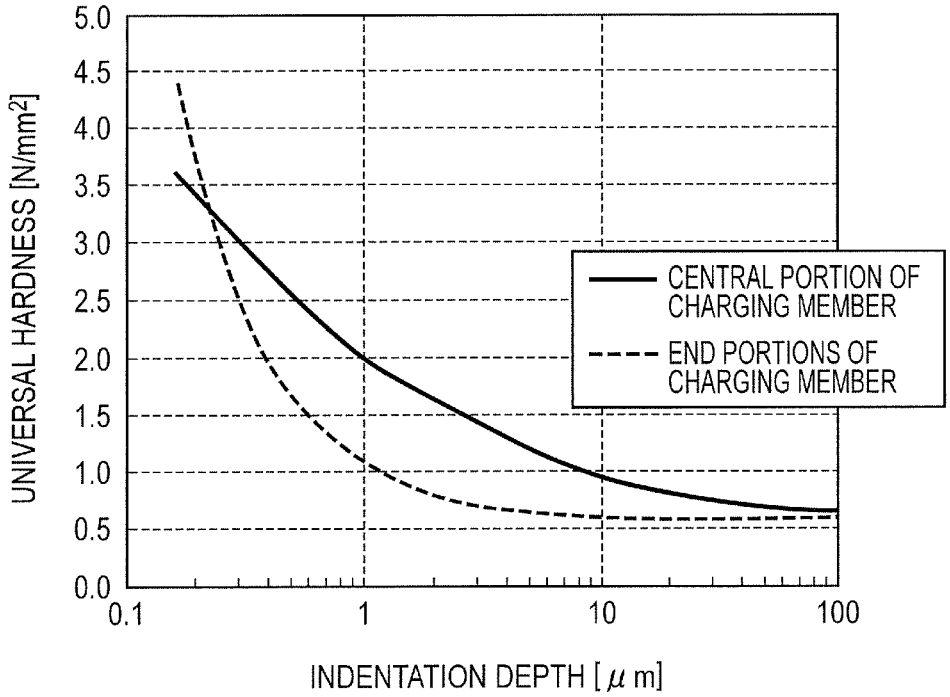
FIG. 6 is a graph showing universal hardness distributions of a charging member according to Example 5.

FIG. 5 shows Measurement Example 1 of universal hardness distributions of the charging roller manufactured by the method involving performing electron beam scanning and irradiation in a fan-shaped fashion from the central portion of the rubber roller as a center toward both end portions through use of the scanning type electron beam irradiation source described above. FIG. 6 shows Measurement Example 2 of universal hardness distributions of the charging roller manufactured by the method involving irradiating the both end portions of the rubber roller with electron beams at a low accelerating voltage and irradiating the central portion with electron beams at a high accelerating voltage while partially masking the rubber roller through use of the area type electron beam irradiation source described above. In each of the graphs, the abscissa axis indicates an indentation depth (μm), i.e., a depth from the surface of the elastic layer, and the ordinate axis indicates a universal hardness ($N/mm^2$).

In this case, the elastic layer of the charging roller according to the present invention has a universal hardness value decreasing from the surface toward the depth direction thereof, and with regard to universal hardness values at the central portion and both end portions in the longitudinal direction of the elastic layer of the charging roller: in the surface of the elastic layer, the values at the both end portions are higher than the value at the central portion; and at a position having a depth of t μm from the surface of the elastic layer, the value at the central portion is higher than the values at the both end portions. In this case, a value for t is preferably 5 μm to 50 μm.

It is considered that the charging roller of the present invention can ensure a uniform nip width between the object to be charged and the charging roller and can make uniform a pressure distribution in a nip width. The charging roller of the present invention can suppress an image failure due to adhesion of toner or an external additive onto the surface of the elastic layer and an image failure due to compression set of the abutting portion of the elastic layer.

The charging roller mentioned in the embodiment of the present invention described above is measured for its electrical resistance value by applying a load of 500 g to each of both ends of the mandrel, and while allowing a drum made of a metal in contact with the charging roller to rotate, allowing the charging roller to rotate according to the rotation. The electrical resistance value of the charging rubber roller in the case of applying a voltage of 200 V to the mandrel and the drum made of a metal is adjusted to $10^3$ to $10^8\Omega$. In addition, the charging roller mentioned in the embodiment of the present invention is used as a member for electrophotography in image forming apparatuses such as an LBP, a copying machine, and a facsimile.

<Electrophotographic Apparatus>

Figure 7:
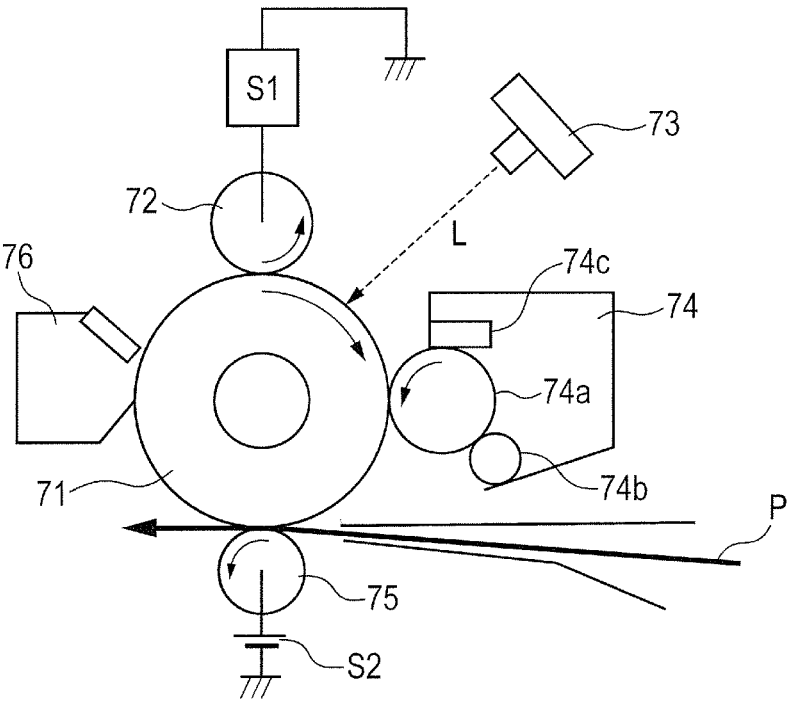
FIG. 7 is an explanatory diagram of an electrophotographic apparatus including a charging member according to the present invention.

FIG. 7 illustrates a cross-sectional view of an electrophotographic apparatus according to the present invention. The electrophotographic apparatus includes, as an image bearing member, an electrophotographic photosensitive member (photosensitive drum) 71 having a drum shape. The electrophotographic photosensitive member 71 is rotationally driven at a predetermined peripheral speed (process speed) clockwise as indicated by the arrow in the figure. The charging roller according to the present invention is used as a charging roller 72.

Charging unit is constructed of the charging roller and a charging bias applying power source S1 for applying a charging bias to the charging roller 72. The elastic layer of the charging roller 72 is brought into pressure contact with the surface of the electrophotographic photosensitive member 71 by applying a load to both end portions of its mandrel. In this example, the charging roller is rotationally driven according to the rotation of the electrophotographic photosensitive member 71. A predetermined DC voltage (set to −1,200 V in this example) is applied from the charging bias applying power source S1 to the charging roller 72, and the surface of the electrophotographic photosensitive member 71 is evenly subjected to a charging treatment so as to have a predetermined polarity and a predetermined potential (a dark portion potential is set to −600 V in this example) (DC charging). In addition to the DC charging, a known charging method such as AC/DC superimposed charging or injection charging may be employed.

When the surface of the electrophotographic photosensitive member 71 subjected to the charging treatment is subjected to image exposure corresponding to image information of interest by exposing unit 73, the potential of the exposure light portion of the charged surface (a light portion potential is set to −350 V in this example) selectively reduces (attenuates), and an electrostatic latent image is formed on the electrophotographic photosensitive member 71.

As developing unit 74, for example, the developing unit 74 in this example is constructed so as to have: a toner carrying member 74*a* for carrying and conveying toner, the toner carrying member being provided for the opening portion of a developer container for storing the toner; a stirring member 74*b* for stirring the stored toner; and a toner regulating member 74*c* for regulating the amount of the toner to be carried by the toner carrying member 74*a* (toner layer thickness). The developing unit 74 selectively allows toner (negative toner) charged so as to be identical in polarity to the charged polarity of the electrophotographic photosensitive member 71 (a developing bias is set to −350 V in this example) to adhere to the exposure light portion of the electrostatic latent image on the surface of the electrophotographic photosensitive member 71 to visualize the electrostatic latent image as a toner image. A developing mode is not particularly limited, and all the existing methods may be employed. Examples of the existing methods include a jumping development mode, a contact development mode, and a magnetic brush mode. In particular, in an electrophotographic apparatus which outputs a color image, a developing roller of a contact developing mode is preferred for the purposes of, for example, alleviating toner flying.

A transfer roller 75 may be used as transfer unit. The transfer roller 75 is brought into contact with the electrophotographic photosensitive member 71 at a predetermined pressing force so as to form a transfer nip portion, and rotates in the forward direction with respect to the rotation of the electrophotographic photosensitive member 71 at substantially the same peripheral speed as the rotating peripheral speed of the electrophotographic photosensitive member 71. Further, a transfer voltage opposite in polarity to the charged polarity of the toner is applied from a transfer bias applying power source S2. A transfer material P is fed into a transfer nip portion from a sheet feeding mechanism portion (not shown) at a predetermined timing, and the back surface of the transfer material P is charged so as to be opposite in polarity to the charged polarity of the toner by the transfer roller 75 to which the transfer voltage has been applied. As a result, at the transfer nip portion, the toner image present on the surface of the electrophotographic photosensitive member 71 is electrostatically transferred onto the front surface side of the transfer material P.

The transfer material P onto which the toner image has been transferred at the transfer nip portion is separated from the electrophotographic photosensitive member 71, and is introduced into toner image fixing unit (not shown) where the toner image is fixed so as to be output as an image-formed product.

A residue on the electrophotographic photosensitive member 71, such as transfer residual toner, is collected from the surface of the electrophotographic photosensitive member 71 by cleaning unit 76 of, for example, a blade type.

Further, as the electrophotographic apparatus, a process cartridge in which multiple members out of the above-mentioned object to be charged (electrophotographic photosensitive member), charging member, developing member, cleaning member, toner, a toner container, a waste toner container, and the like are integrally supported may be detachably mountable to a main body of an electrophotographic apparatus such as a copying machine or a laser beam printer. The adoption of the process cartridge has advantages, for example, in that it is possible to replace severely deteriorated members at a time, and it is possible to replenish toner and to collect waste toner while preventing toner flying.

<Process Cartridge>

Figure 8:
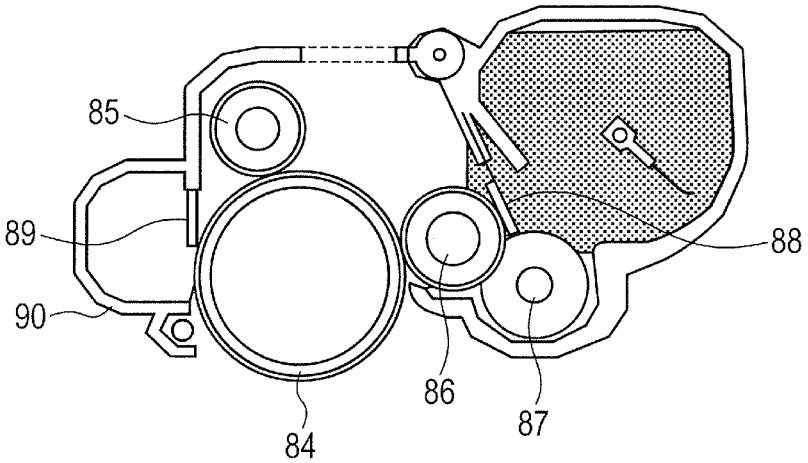
FIG. 8 is an explanatory diagram of a process cartridge according to the present invention.

A process cartridge of the present invention has only to be a process cartridge including the charging member and electrophotographic photosensitive member integrally supported, in which the process cartridge is detachably mountable to a main body of an electrophotographic apparatus. As an example thereof, as illustrated in FIG. 8, there may be given a process cartridge including an electrophotographic photosensitive member 84, a charging member having a charging roller 85, a developing member provided with a developing roller 86, a toner supply roller 87, and a developing blade 88, a cleaning member constructed of a cleaning blade 89 and a waste toner container 90, and the like, the members being integrally supported, in which the process cartridge is detachably mountable to a main body of an electrophotographic apparatus.

EXAMPLES

Hereinafter, the present invention is more specifically described by way of examples and comparative examples.

Example 1

<1. Production of Rubber Roller>

Five kinds of materials (Component 1) shown in Table 1 below were mixed with a 6-liter pressure kneader for 15 minutes. Two kinds of materials (Component 2) were further added thereto, and the mixture was kneaded with an open roll for 15 minutes to prepare an unvulcanized rubber composition.

TABLE 1

| Component | Material | Part(s) by mass |
|---|---|---|
| Component 1 | NBR (trade name: "JSR N230SV", manufactured by JSR Corporation) | 100 |
| | Carbon black (trade name: "SEAST 600", manufactured by TOKAI CARBON CO., LTD.) | 45 |
| | Zinc stearate (trade name: "Zinc stearate", manufactured by NOF CORPORATION) | 1 |
| | Zinc oxide (trade name: "Zinc oxide type II", manufactured by Sakai Chemical Industry Co., Ltd.) | 5 |
| | Calcium carbonate (trade name: "SUPER #2300", manufactured by MARUO CALCIUM CO., LTD.) | 20 |
| Component 2 | Vulcanization accelerator (TBzTD) | 4.5 |
| | Sulfur as vulcanizing agent | 1.2 |

Further, a bar made of stainless steel having an outer diameter of 5 mmϕ and a length of 250 mm was prepared as a mandrel. An electro-conductive adhesive (trade name: "METALOC U-20", manufactured by TOYOKAGAKU KENKYUSHO CO., LTD.) was applied onto a region having a width of 230 mm with respect to the central portion in the longitudinal direction of the columnar surface of the mandrel regarded as the center, and was dried at 80° C. for 30 minutes.

Next, the mandrel was introduced into an extruder equipped with a crosshead. The mandrel and the unvulcanized rubber composition prepared in the foregoing were co-extruded to produce an unvulcanized rubber roller having a diameter of 7.95 mm, in which a layer of the unvulcanized rubber composition was formed on the peripheral surface of the mandrel. It should be noted that an extruder having a cylinder diameter of 45 mm and a ratio of (screw effective length L/screw diameter D) of 20 was used as the extruder. Further, the temperature of the extruder was set as follows: head portion: 90° C.; cylinder portion: 90° C.; and screw portion: 90° C.

Both end sides of the unvulcanized rubber layer of the molded unvulcanized rubber roller were removed by cutting so that the length in the longitudinal direction of the unvulcanized rubber layer was 230 mm. After that, the unvulcanized rubber roller was heated at a temperature of 160° C. for 1 hour to vulcanize the unvulcanized rubber layer.

Next, the vulcanized rubber layer was dry-ground with a grinding machine of a plunge mode using rotating grindstone so as to be processed into such a crown shape that the outer diameter at the central portion in the longitudinal direction of the rubber layer was 7.65 mm and the outer diameters at positions 90 mm away from the central portion toward both end directions, respectively, were 7.50 mm. In the rubber roller having the rubber layer with the crown shape thus obtained, the thickness at the central portion and the crown amount of the rubber layer was 1.325 mm and 150 μm, respectively.

<2. Production of Charging Roller>

Through use of the scanning type electron beam irradiation source illustrated in FIG. 3, the surface of the rubber layer of the rubber roller was subjected to the surface treatment of the rubber layer involving performing electron beam irradiation in a fan-shaped fashion symmetrically from the central portion in the longitudinal direction of the rubber roller regarded as the center toward the both end portions. Thus, a charging roller 1 according to the present invention was obtained.

An electron beam irradiation apparatus (trade name: "Low-energy electron beam irradiation source EB-ENGINE", manufactured by Hamamatsu Photonics K.K.) was used for the electron beam irradiation. An atmosphere upon the irradiation was purged with nitrogen gas so that the concentration of oxygen in the atmosphere was 500 ppm. The rubber roller was irradiated with electron beams by being conveyed at a treatment speed of 10 mm/s in a direction perpendicular to the paper surface of FIG. 3 while being allowed to rotate at 300 rpm with respect to the mandrel as a rotation axis. With regard to electron beam irradiation conditions, an electron current was adjusted so as to achieve a dose of 1,000 kGy at an accelerating voltage of 70 kV.

(Evaluation 1: Universal Hardness Measurement)

The universal hardness distributions at the central portion and both end portions (at positions 90 mm away from the central portion toward both end directions, respectively) in the longitudinal direction of the charging roller 1 was measured by measuring the surface hardness of the elastic layer of the charging roller 1 with a universal hardness meter. An ultra-micro hardness meter (trade name: H-100V, manufactured by Fischer) was used for the measurement. Further, a quadrangular pyramid diamond indenter was used as an indenter. An indentation speed was as shown in the following conditional equation (3). It should be noted that F represents a force and t represents a time in the equation (3).

$$dF/dt = 1{,}000 \text{ mN}/200 \text{ s} \quad (3)$$

FIG. 5 shows the measurement results. The maximum universal hardness value in a region from the surface to a depth of 1 μm at each of the central portion and both end portions in the longitudinal direction of the elastic layer of the charging roller 1 was defined as "surface universal hardness", and the universal hardness at the position having a depth of 10 μm from the surface of the elastic layer of the charging roller 1 was defined as "universal hardness (t=10 μm position)."

The "surface universal hardness" at the central portion and both end portions in the longitudinal direction of the elastic layer of the charging roller 1 were 3.85 N/mm$^2$ and 4.52 N/mm$^2$, respectively. Further, the "universal hardness (t=10 μm position)" at the central portion and both end portions in the longitudinal direction of the elastic layer of the charging roller 1 were 0.68 N/mm$^2$ and 0.61 N/mm$^2$, respectively.

(Evaluation 2: Image Evaluation)

The charging roller 1 was incorporated into a process cartridge so as to be brought into pressure contact with an electrophotographic photosensitive member in a state in which a load of 500 g were applied to each of both ends thereof.

Next, the process cartridge was mounted on an electrophotographic apparatus for conveying and outputting A4-sized paper in the longitudinal direction (trade name: LBP7200C, manufactured by Canon Inc.). Then, the electrophotographic apparatus was used to output 6,000 electrophotographic images. The electrophotographic images output in this case are each such an image that an alphabetical letter "E" having a size of 4 points is printed on A4-sized paper at a printing density of 1%. Further, the electrophotographic images were output according to a so-called intermittent mode in which the rotation of an electrophotographic photosensitive member drum was stopped over 10 seconds every time two images were output. Further, after the completion of the output of the 6,000 electrophotographic images, one halftone image was subsequently output.

After that, the process cartridge was taken out from the electrophotographic apparatus, and the charging roller was taken out from the process cartridge, and was visually observed for the adhesion state of dirt on its surface. Further, the halftone image was visually observed for the presence or absence of a defect such as a "streak" at a position corresponding to the dirt on the surface of the charging roller. Table 2 shows the evaluation criteria.

TABLE 2

| Rank | Evaluation criteria |
|---|---|
| A | No dirt is observed. |
| B | Dirt is slightly observed at a central portion at such a level that the dirt does not cause any defect in a halftone image. |
| C | Dirt is observed at a central portion at such a level that the dirt causes a defect in a halftone image. |

Examples 2 and 3

Two rubber rollers each having a vulcanized rubber layer with a crown shape were produced in the same manner as in Example 1. A charging roller 2 and a charging roller 3 were obtained in the same manner as in the charging roller 1 according to Example 1 except that electron beam irradiation conditions for the elastic layers of those rubber rollers were changed as shown in Table 5. Those charging rollers were subjected to Evaluation 1 and Evaluation 2 described in Example 1.

Example 4

A rubber roller was produced in the same manner as in Example 1 except that materials shown in Table 3 below were used. Then, a charging roller 4 was produced in the same manner as in Example 1 except that the rubber roller was used. The charging roller was subjected to Evaluation 1 and Evaluation 2 described in Example 1.

TABLE 3

| Component | Material | Part(s) by mass |
|---|---|---|
| Component 1 | SBR (trade name: "TUFDENE 2003", manufactured by Asahi Kasei Chemicals Corporation) | 100 |
| | Carbon black (trade name: "SEAST 600", manufactured by TOKAI CARBON CO., LTD.) | 49 |
| | Zinc stearate (trade name: "Zinc stearate", manufactured by NOF CORPORATION) | 1 |
| | Zinc oxide (trade name: "Zinc oxide type II", manufactured by Sakai Chemical Industry Co., Ltd.) | 5 |
| | Calcium carbonate (trade name: "SUPER #2300", manufactured by MARUO CALCIUM CO., LTD.) | 20 |
| Component 2 | Vulcanization accelerator (TBzTD) | 1 |
| | Vulcanization accelerator (TBSI) | 1 |
| | Sulfur as vulcanizing agent | 1.2 |

Example 5

A rubber roller was obtained in the same manner as in Example 1. Next, the rubber layer of the rubber roller was treated by the following method to prepare a charging roller 5.

That is, the surface of the rubber layer at a central portion except both end portions each having a width of 15 mm in the length of 230 mm in the longitudinal direction of the rubber layer of the rubber roller was covered with a sheet made of stainless steel having a thickness of 100 μm. In this state, the surface of the rubber layer was irradiated with electron beams at an accelerating voltage of 80 kV through use of an area type electron beam irradiation source (trade name: "EC150/45/40 mA", manufactured by IWASAKI ELECTRIC CO., LTD.), thereby performing the surface treatment of the both end portions each having a width of 15 mm of the rubber layer.

Next, portions except portions 15 mm to 30 mm away from the both ends in the longitudinal direction of the rubber layer, respectively, were covered with a sheet made of stainless steel. The portions 15 mm to 30 mm away from the both ends in the longitudinal direction of the rubber layer, respectively, were irradiated with electron beams at an accelerating voltage of 90 kV.

Next, portions except portions 30 mm to 45 mm away from the both ends in the longitudinal direction of the rubber layer, respectively, were covered with a sheet made of stainless steel. The portions 30 mm to 45 mm away from the both ends in the longitudinal direction of the rubber layer, respectively, were irradiated with electron beams at an accelerating voltage of 100 kV.

Next, portions except portions 45 mm to 60 mm away from the both ends in the longitudinal direction of the rubber layer, respectively, were covered with a sheet made of stainless steel. The portions 45 mm to 60 mm away from the both ends in the longitudinal direction of the rubber layer, respectively, were irradiated with electron beams at an accelerating voltage of 110 kV.

Next, portions except portions 60 mm to 75 mm away from the both ends in the longitudinal direction of the rubber layer, respectively, were covered with a sheet made of stainless steel. The portions 60 mm to 75 mm away from the both ends in the longitudinal direction of the rubber layer, respectively, were irradiated with electron beams at an accelerating voltage of 120 kV.

Next, portions except portions 75 mm to 90 mm away from the both ends in the longitudinal direction of the rubber layer, respectively, were covered with a sheet made of stainless steel. The portions 75 mm to 90 mm away from the both ends in the longitudinal direction of the rubber layer, respectively, were irradiated with electron beams at an accelerating voltage of 130 kV.

Next, portions except portions 90 mm to 105 mm away from the both ends in the longitudinal direction of the rubber layer, respectively, were covered with a sheet made of stainless steel. The portions 90 mm to 105 mm away from the both ends in the longitudinal direction of the rubber layer, respectively, were irradiated with electron beams at an accelerating voltage of 140 kV.

In addition, portions except a portion having a width of 10 mm from the center in the longitudinal direction of the rubber layer toward each of both end directions (portion having a total width of 20 mm) were covered with a sheet made of stainless steel. The portion having a width of 20 mm was irradiated with electron beams at an accelerating voltage of 150 kV. Thus, a charging roller 5 was obtained.

It should be noted that an electron beam irradiation apparatus (trade name: "EC150/45/40 mA", manufactured by IWASAKI ELECTRIC CO., LTD.) was used for the electron beam irradiation. An atmosphere upon the irradiation was purged with nitrogen gas so that the concentration of oxygen in the atmosphere was 500 ppm. In addition, the rubber roller was conveyed at a treatment speed of 10 mm/s while being allowed to rotate at 500 rpm. With regard to electron beam irradiation conditions, an electron current was adjusted so as to achieve a dose of 1,000 kGy at each accelerating voltage.

The charging roller was subjected to Evaluation 1 and Evaluation 2 described in Example 1. FIG. 6 shows the measurement results of universal hardness distributions at the central portion and both end portions (at positions 90 mm away from the central portion toward both end directions, respectively) in the longitudinal direction of the charging roller 5.

Example 6

An unvulcanized rubber roller having a diameter of 8.3 mm was produced by the same method as in Example 1 except that a bar made of stainless steel having a diameter of 6 mm and a length of 250 mm was used as the mandrel, and an unvulcanized rubber layer was vulcanized in the same manner as in Example 1. Next, the vulcanized rubber layer was ground by the same method as in Example 1 to produce a rubber roller having diameters shown in Table 4 at the central portion and positions 90 mm away from the central portion toward both end directions, respectively, in the longitudinal direction of the rubber layer. Table 4 shows the thickness at the central portion and crown amount of the rubber layer of the rubber roller as well.

Next, the rubber roller was irradiated with electron beams under the same conditions as in Example 1 to prepare a charging roller 6. The charging roller was subjected to Evaluation 1 and Evaluation 2 described in Example 1.

Example 7

An unvulcanized rubber roller having a diameter of 12.5 mm was produced by the same method as in Example 1 except that a bar made of stainless steel having a diameter of 6 mm and a length of 250 mm was used as the mandrel, and an unvulcanized rubber layer was vulcanized in the same manner as in Example 1. Next, the vulcanized rubber layer was ground by the same method as in Example 1 to produce a rubber roller having diameters shown in Table 4 at the central portion and positions 90 mm away from the central portion toward both end directions, respectively, in the longitudinal direction of the rubber layer. Table 4 shows the thickness at the central portion and crown amount of the rubber layer of the rubber roller as well.

Next, the rubber roller was irradiated with electron beams under the same conditions as in Example 1 to prepare a charging roller 7. The charging roller was subjected to Evaluation 1 and Evaluation 2 described in Example 1.

Examples 8, 9, 12, and 13

Unvulcanized rubber rollers were each produced in the same manner as in Example 1 except that diameters at the central portion in the longitudinal direction of the unvulcanized rubber layer and at positions 90 mm away from the central portion toward both end directions, respectively, were changed as shown in Table 4, and unvulcanized rubber layers were vulcanized in the same manner as in Example 1. Next, the vulcanized rubber layers were ground by the same method as in Example 1 to produce rubber rollers each having diameters shown in Table 4 at the central portion and positions 90 mm away from the central portion toward both end directions, respectively, in the longitudinal direction of the rubber layer. Table 4 shows the thickness at the central portion and crown amount of the rubber layer of each of the rubber rollers as well.

Next, those rubber rollers were irradiated with electron beams under the same conditions as in Example 1 to prepare charging rollers 8, 9, 12, and 13. The charging rollers were each subjected to Evaluation 1 and Evaluation 2 described in Example 1.

Example 10

An unvulcanized rubber roller having a diameter of 7.5 mm was produced by the same method as in Example 1 except that a bar made of stainless steel having a diameter of 6 mm and a length of 250 mm was used as the mandrel, and an unvulcanized rubber layer was vulcanized in the same manner as in Example 1. Next, the vulcanized rubber layer was ground by the same method as in Example 1 to produce a rubber roller having diameters shown in Table 4 at the central portion and positions 90 mm away from the central portion toward both end directions, respectively, in the longitudinal direction of the rubber layer. Table 4 shows the thickness at the central portion and crown amount of the rubber layer of the rubber roller as well.

Next, the rubber roller was irradiated with electron beams under the same conditions as in Example 1 to prepare a charging roller 10. The charging roller was subjected to Evaluation 1 and Evaluation 2 described in Example 1.

Example 11

An unvulcanized rubber roller having a diameter of 14.4 mm was produced by the same method as in Example 1 except that a bar made of stainless steel having a diameter of 6 mm and a length of 250 mm was used as the mandrel, and an unvulcanized rubber layer was vulcanized in the same manner as in Example 1. Next, the vulcanized rubber layer was ground by the same method as in Example 1 to produce a rubber roller having diameters shown in Table 4 at the central portion and positions 90 mm away from the central portion toward both end directions, respectively, in the longitudinal direction of the rubber layer. Table 4 shows the thickness at the central portion and crown amount of the rubber layer of the rubber roller as well.

Next, the rubber roller was irradiated with electron beams under the same conditions as in Example 1 to prepare a charging roller 11. The charging roller was subjected to Evaluation 1 and Evaluation 2 described in Example 1.

Comparative Example 1

A charging roller C1 was produced in the same manner as in Example 5 except that the surface of the rubber layer of the rubber roller was irradiated with electron beams at an accelerating voltage of 150 kV without covering the surface with the sheet made of stainless steel.

It should be noted that, upon the electron beam irradiation, an ambient atmosphere was purged with nitrogen gas so that the concentration of oxygen in the atmosphere was 500 ppm, and the rubber roller was conveyed at a treatment speed of 10 mm/s while being allowed to rotate at 500 rpm. With regard to the electron beam irradiation conditions, an electron current was adjusted so as to achieve a dose of 1,000 kGy at an accelerating voltage of 150 kV. The charging roller was subjected to Evaluation 1 and Evaluation 2 described in Example 1.

Comparative Example 2

A rubber roller was produced by the same method as in Example 1. Next, a portion (having a width of 150 mm in the longitudinal direction) except both end portions each having a width of 40 mm in the longitudinal direction of the elastic layer of the rubber roller was covered with a sheet made of stainless steel having a thickness of 100 μm. In this state, the surface of the elastic layer was irradiated with electron beams while adjusting an electron current so as to achieve a dose of 2,000 kGy at an accelerating voltage of 150 kV through use of an area type electron beam irradiation source.

After that, the both end portions each having a width of 40 mm in the longitudinal direction of the elastic layer were covered with a sheet made of stainless steel having a thickness of 100 μm. In this state, electron beam irradiation was performed while adjusting an electron current so as to achieve a dose of 1,000 kGy at an accelerating voltage of 150 kV.

Thus, a charging roller C2 was obtained by the treatment in which only an electron beam dose was different between the central portion and both end portions in the longitudinal direction of the elastic layer. The charging roller was subjected to Evaluation 1 and Evaluation 2 described in Example 1.

With regard to each of the rubber rollers according to Examples 1 to 13 and Comparative Examples 1 and 2 described above, Table 4 shows the diameters at the central portion in the longitudinal direction of the elastic layer and at the positions 90 mm away from the central portion in the longitudinal direction toward both end directions, respectively, the thickness of the elastic layer at the central portion in the longitudinal direction of the elastic layer, and the crown amount based on the diameters at the central portion in the longitudinal direction of the elastic layer and at the positions 90 mm away from the central portion in the longitudinal direction toward both end directions, respectively. Further, Table 5 shows the electron beam irradiation conditions in each of Examples and Comparative Examples. In addition, Table 6 shows the results of Evaluation 1 and Evaluation 2 on the charging rollers 1 to 13 according to Examples 1 to 13 and the charging rollers C1 and C2 according to Comparative Examples 1 and 2.

TABLE 4

| | | | Diameter (mm) of rubber roller | | | |
|---|---|---|---|---|---|---|
| | | Charging roller No. | Central portion in longitudinal direction of elastic layer | Positions 90 mm away from central portion in longitudinal direction of elastic layer toward both end directions, respectively | Thickness (mm) at central portion in longitudinal direction of elastic layer | Crown amount (μm) |
| Example | 1 | 1 | 7.65 | 7.5 | 1.325 | 150 |
| | 2 | 2 | Same as above | Same as above | 1.325 | 150 |
| | 3 | 3 | Same as above | Same as above | 1.325 | 150 |
| | 4 | 4 | Same as above | Same as above | 1.325 | 150 |
| | 5 | 5 | Same as above | Same as above | 1.325 | 150 |
| | 6 | 6 | 7.9 | 7.75 | 0.950 | 150 |
| | 7 | 7 | 12.1 | 11.95 | 3.100 | 150 |
| | 8 | 8 | 7.65 | 7.59 | 1.325 | 60 |
| | 9 | 9 | 7.65 | 7.43 | 1.325 | 220 |
| | 10 | 10 | 6.9 | 6.75 | 0.450 | 150 |
| | 11 | 11 | 14 | 13.85 | 4.000 | 150 |
| | 12 | 12 | 7.65 | 7.6 | 1.325 | 50 |
| | 13 | 13 | 7.65 | 7.42 | 1.325 | 230 |
| Comparative Example | 1 | C1 | 7.65 | 7.5 | 1.325 | 150 |
| | 2 | C2 | 7.65 | 7.5 | 1.325 | 150 |

TABLE 5

| | | Electron beam irradiation condition | | |
|---|---|---|---|---|
| | | Accelerating voltage (kV) | Electron beam dose (kGy) | Schematic diagram of electron beam irradiation source |
| Example | 1 | 70 | 1,000 | FIG. 3 |
| | 2 | 70 | 2,000 | Same as above |
| | 3 | 70 | 200 | Same as above |
| | 4 | 70 | 1,000 | Same as above |
| | 5 | 80→150 | 1,000 | FIG. 4 |
| | 6 | 70 | 1,000 | FIG. 3 |
| | 7 | 70 | 1,000 | Same as above |
| | 8 | 70 | 1,000 | Same as above |
| | 9 | 70 | 1,000 | Same as above |
| | 10 | 70 | 1,000 | Same as above |
| | 11 | 70 | 1,000 | Same as above |
| | 12 | 70 | 1,000 | Same as above |
| | 13 | 70 | 1,000 | Same as above |
| Comparative Example | 1 | 150 | 1,000 | — |
| | 2 | 150 | 1,000 | — |

TABLE 6

| | | Evaluation 1: universal hardness (N/mm$^2$) | | | | |
|---|---|---|---|---|---|---|
| | | Central portion in longitudinal direction | | End portions in longitudinal direction | | |
| | | Surface | Pre-determined depth position | Surface | Pre-determined depth position | E-valu-ation 2 |
| Example | 1 | 3.85 | 0.68 | 4.52 | 0.61 | A |
| | 2 | 5.92 | 0.75 | 6.45 | 0.62 | B |
| | 3 | 1.09 | 0.64 | 1.26 | 0.60 | A |
| | 4 | 4.08 | 0.72 | 4.77 | 0.65 | A |
| | 5 | 3.70 | 0.98 | 4.35 | 0.64 | A |
| | 6 | 5.53 | 0.71 | 6.11 | 0.66 | B |
| | 7 | 2.01 | 0.64 | 2.34 | 0.61 | A |
| | 8 | 3.77 | 0.69 | 4.70 | 0.61 | A |
| | 9 | 3.64 | 0.68 | 4.33 | 0.62 | A |
| | 10 | 6.03 | 0.72 | 6.44 | 0.68 | B |
| | 11 | 2.32 | 0.62 | 2.46 | 0.60 | A |
| | 12 | 3.57 | 0.69 | 4.66 | 0.60 | A |
| | 13 | 3.81 | 0.68 | 4.05 | 0.61 | A |
| Comparative Example | 1 | 3.52 | 1.01 | 3.52 | 1.01 | D |
| | 2 | 3.67 | 1.11 | 6.02 | 1.86 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-038973, filed Feb. 24, 2012, which is hereby incorporated by reference herein in its entirety.

| Reference Signs List | |
|---|---|
| 11 | mandrel |
| 12 | elastic layer |
| 13 | cured region in surface portion of elastic layer |
| 21 | electron beam generating portion |
| 22 | irradiation chamber |
| 23, 33, 43 | irradiation hole |
| 24 | electron source (electron gun) |
| 25, 44 | accelerating tube |
| 26, 34, 45 | filament |

-continued

| Reference Signs List | |
|---|---|
| 27 | irradiation hole foil |
| 28, 39, 47 | rubber roller |
| 29 | member for roller rotation |
| 31, 41 | electron gun |
| 32, 42 | container for electron beam generating portion |
| 35 | electron beam passing hole |
| 36 | electromagnetic coil |
| 37 | deflecting coil |
| 38, 46 | irradiation window |
| 48 | masking |
| 71, 84 | electrophotographic photosensitive member |
| 72, 85 | charging roller |
| 73 | exposing unit |
| 74 | developing unit |
| 75 | transfer roller |
| 76 | cleaning unit |

What is claimed is:

1. A charging member, comprising:

a mandrel; and an electro-conductive elastic layer, wherein:

the elastic layer has a universal hardness decreasing from a surface toward a depth direction thereof; and the universal hardnesses of the elastic layer at a central portion and both end portions in a longitudinal direction of the charging member satisfy the following relationships:

with respect to the surface of the elastic layer, the universal hardnesses at the both end portions are higher than that at the central portion; and with respect to a position having a depth of t μm from the surface of the elastic layer, the universal hardness at the central portion is higher than those at the both end portions.

2. The charging member according to claim 1, wherein a thickness of the elastic layer is 0.5 mm or more and 3.5 mm or less.

3. The charging member according to claim 1, wherein the depth t is 5 μm or more and 50 μm or less.

4. The charging member according to claim 1, wherein a crown amount of the charging member is 60 μm or more and 220 μm or less, provided that the crown amount is a value calculated from the following equation (1) when an outer diameter at the central portion in the longitudinal direction of the charging member is defined as D2 (μm) and outer diameters at the both end portions (positions 90 mm away from the central portion toward both end directions, respectively) are defined as D1 (μm) and D3 (μm), respectively:

$$\text{Crown amount } C = D2 - (D1 + D3)/2 \quad (1).$$

5. The charging member according to claim 1, wherein the elastic layer comprises a rubber.

6. The charging member according to claim 5, wherein the rubber is a styrene-butadiene rubber or an acrylonitrile-butadiene rubber.

7. The charging member according to claim 1, wherein the elastic layer further comprises an electro-conductive agent.

8. The charging member according to claim 1, wherein the elastic layer of the charging member has such a crown shape that outer diameters at the both end portions are smaller than an outer diameter at the central portion in the longitudinal direction of the charging member.

9. An electrophotographic apparatus, comprising:
the charging member according to claim 1; and
an electrophotographic photosensitive member disposed in contact with the charging member.

10. A process cartridge, comprising:
the charging member according to claim 1; and
an electrophotographic photosensitive member,
wherein the process cartridge is detachably mountable to a main body of an electrophotographic apparatus.

* * * * *